US011136723B2

(12) United States Patent
Pang et al.

(10) Patent No.: US 11,136,723 B2
(45) Date of Patent: Oct. 5, 2021

(54) HEAT SEALABLE BARRIER PAPERBOARD

(71) Applicant: WestRock MWV, LLC, Atlanta, GA (US)

(72) Inventors: Jiebin Pang, Glen Allen, VA (US); Natasha G. Melton, Richmond, VA (US); Teresa Krug, Henrico, VA (US); Steven Parker, Raleigh, NC (US)

(73) Assignee: WESTROCK MWV, LLC, Atlanta, GA (US)

( * ) Notice: Subject to any disclaimer, the term of this patent is extended or adjusted under 35 U.S.C. 154(b) by 232 days.

(21) Appl. No.: 15/902,166

(22) Filed: Feb. 22, 2018

(65) Prior Publication Data

US 2018/0245291 A1 Aug. 30, 2018

Related U.S. Application Data

(60) Provisional application No. 62/463,857, filed on Feb. 27, 2017.

(51) Int. Cl.

| | |
|---|---|
| ***D21J 1/08*** | (2006.01) |
| ***D21H 19/12*** | (2006.01) |
| ***D21H 19/60*** | (2006.01) |
| ***D21H 19/38*** | (2006.01) |
| ***D21H 19/40*** | (2006.01) |
| ***D21H 19/58*** | (2006.01) |
| ***D21H 27/10*** | (2006.01) |
| *D21H 19/82* | (2006.01) |

(52) U.S. Cl.

CPC ..... *D21J 1/08* (2013.01); *D21H 19/12* (2013.01); *D21H 19/385* (2013.01); *D21H 19/40* (2013.01); *D21H 19/58* (2013.01); *D21H 19/60* (2013.01); *D21H 27/10* (2013.01); *D21H 19/82* (2013.01)

(58) Field of Classification Search

None

See application file for complete search history.

(56) References Cited

U.S. PATENT DOCUMENTS

| | | | | |
|---|---|---|---|---|
| 5,763,100 | A * | 6/1998 | Quick | B65D 65/42 428/486 |
| 2002/0136913 | A1 | 9/2002 | Schaedler | |
| 2006/0102304 | A1* | 5/2006 | Nutbeem | D21H 19/38 162/135 |
| 2007/0232743 | A1* | 10/2007 | Laviolette | D21H 19/40 524/445 |
| 2011/0046284 | A1 | 2/2011 | Berube | |
| 2012/0302660 | A1 | 11/2012 | Stanssens | |
| 2014/0004337 | A1* | 1/2014 | Hayes | D21C 5/02 428/327 |
| 2015/0111011 | A1 | 4/2015 | Hoekstra | |
| 2017/0002517 | A1 | 1/2017 | Pang | |

FOREIGN PATENT DOCUMENTS

| | | | |
|---|---|---|---|
| EP | 0991815 | A1 | 4/2000 |
| EP | 2719825 | A1 | 4/2014 |
| WO | WO9426413 | A1 | 11/1994 |
| WO | WO9426513 | A1 | 11/1994 |

* cited by examiner

*Primary Examiner* — Chinessa T. Golden

(74) *Attorney, Agent, or Firm* — Neil G. Cohen

(57) ABSTRACT

An aqueous coated paperboard is disclosed which exhibits good barrier properties and anti-blocking behavior and is heat sealable.

23 Claims, 4 Drawing Sheets

FIGURE 1B

FIGURE 1A
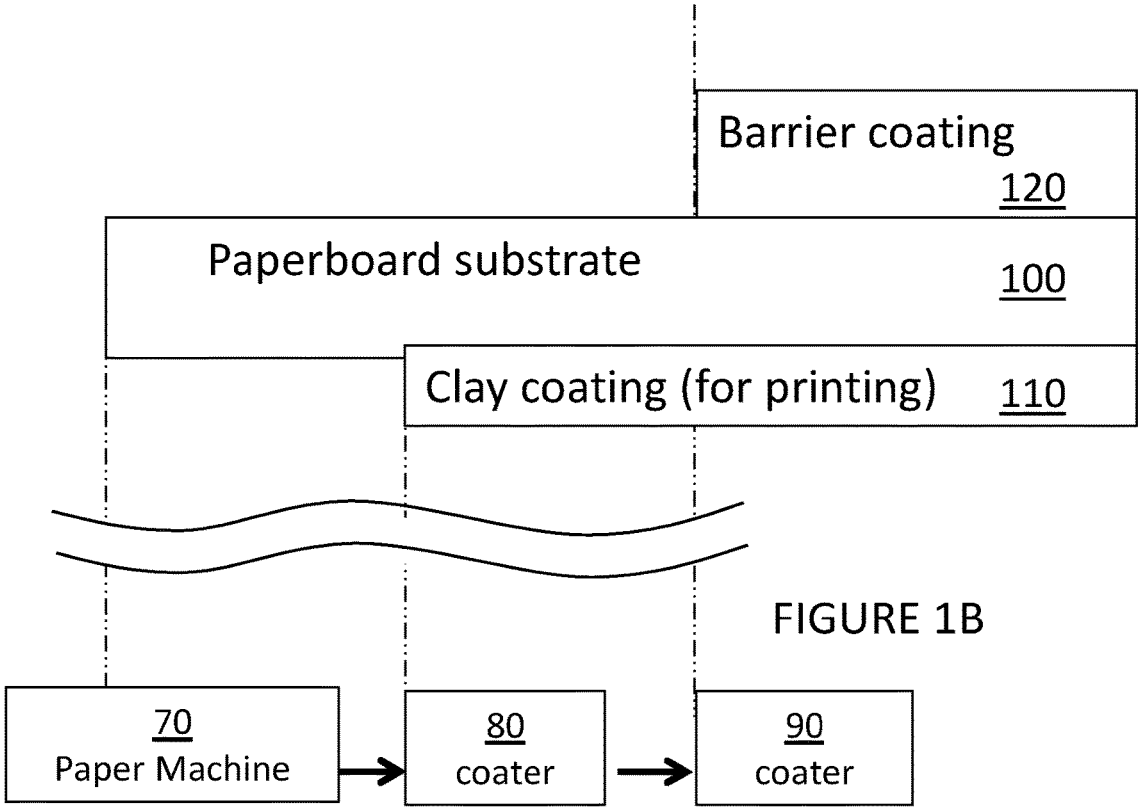
FIGURE 1B
FIGURE 2
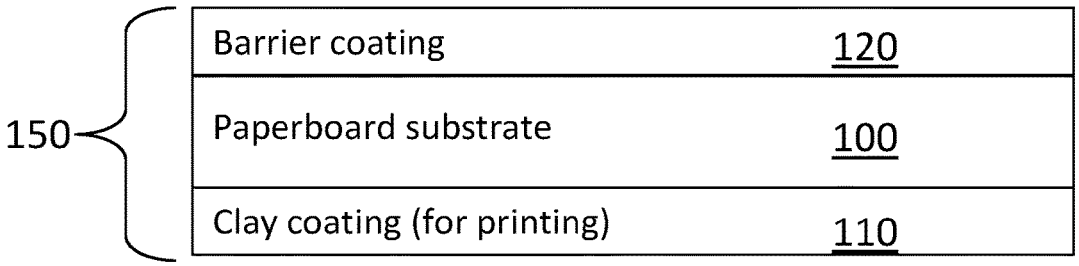

Blocking (0-4)
5
4
3
2
1
0
4
8
14
23
39
Tg (°C)

300 oF
350 oF
400 oF
Heat Seal (% fiber tear)
120
100
80
60
40
20
0
100
100
100
80
100
100
90
100
100
90
100
90
0
4
8
14
23
39
Tg (°C)

FIGURE 6A
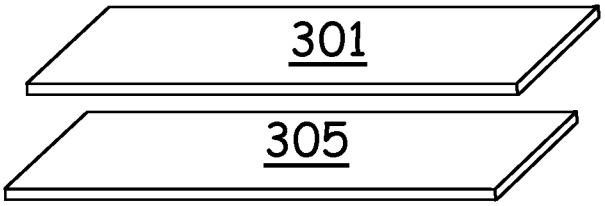
FIGURE 6B
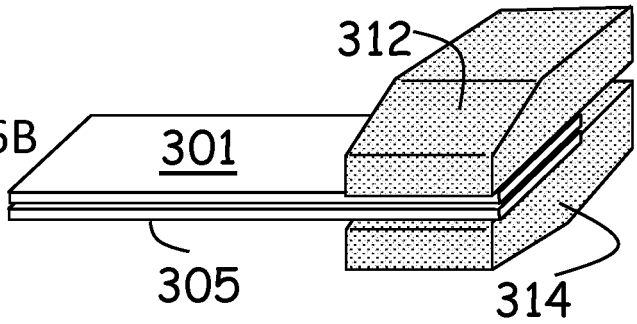
FIGURE 6C
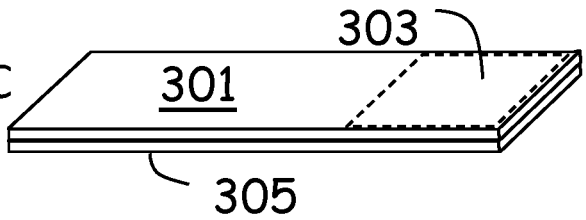
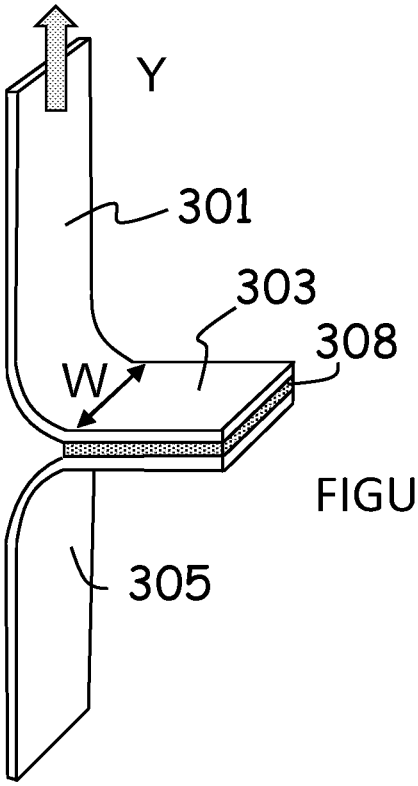
FIGURE 6D

HEAT SEALABLE BARRIER PAPERBOARD

BACKGROUND OF THE INVENTION

Food or food service packages using paper or paperboard often require enhanced barrier properties, including oil, grease, water, and/or moisture vapor barrier. Additionally, many paper or paperboard packages, for example, paper or paperboard cups for food or drink services, also require the paper or paperboard be heat sealable, making it possible to form cups on a cup machine. Polyethylene (PE) extrusion coated paperboard currently still dominate in such applications by providing both required barrier and heat seal properties. However, packages including paper cups using a PE extrusion coating have difficulties in repulping and are not as easily recyclable as conventional paper or paperboard, causing environmental concerns if these packages go to landfill. There are increasing demands for alternative solutions including coating technologies to replace paperboard packages that contain a PE coating or film layer.

Repulpable aqueous coating is one of the promising solutions to address this need. However, most polymers in aqueous coatings are amorphous and do not have a melting point as PE. Therefore, binders or polymers in aqueous coatings often gradually soften or become sticky at elevated temperature (even at, for example, 120-130° F. (48.9-54.4° C.) and/or pressure in production, storage, shipping, or converting process of aqueous coated paperboard, causing blocking issue of the coated paperboard, which usually does not occur with PE coated paperboard in practical applications. This blocking issue becomes even more critical for aqueous barrier coated paperboard that requires high barrier properties and also needs to be able to heat seal in converting packages such as cups.

The invention is directed to a method of making a paper or paperboard with barrier properties that are provided by an aqueous coating that is also heat sealable. Typical aqueous coatings used for such purposes may contain a high level (or even pure) binder or specialty polymer, that can end up blocking when stored or shipped under elevated temperature, humidity, or pressure. The blocking behavior is an even greater problem with materials that are designed to be heat sealable.

BRIEF SUMMARY OF THE INVENTION

In the inventive paperboard, a heat sealing layer is provided by an aqueous coating whose binder (or polymer) component has a relatively high glass transition temperature ($T_g$). The inventive board offers heat seal capability and provides barrier properties without the usual blocking problems.

BRIEF DESCRIPTION OF THE DRAWINGS

FIG. 1A is a schematic representation of a cross section of a paperboard with barrier properties provided by an aqueous coating;

FIG. 1B is a schematic representation of a process for making the paperboard of FIG. 1A;

FIG. 2 is a schematic representation of a cross section of the paperboard of FIG. 1A;

FIGS. 6A-6D illustrate a peel test method to measure fiber tear.

DETAILED DESCRIPTION OF THE INVENTION

Figure 3:
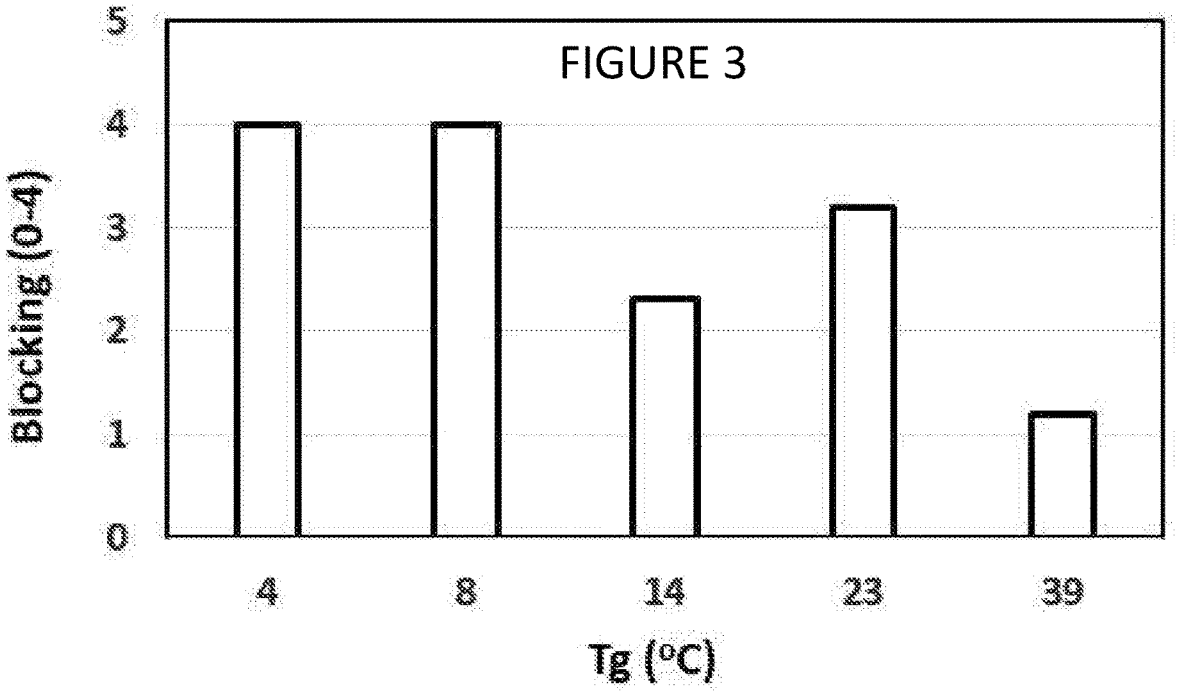
FIG. 3 illustrates results of blocking tests for coated paperboard samples.

The invention provides a paperboard coated with an aqueous barrier coating, providing barrier properties and being heat sealable, but with minimal tendency to block.

As shown in FIG. 1A, a substrate material 100 may be selected from any conventional paperboard grade, for example especially solid bleached sulfate (SBS) ranging in caliper upward from about 10 pt. to about 24 pt (0.010" to 0.024"; 254 μm to 610 μm). An example of such a substrate is a 13-point (330 μm) SBS cupstock board manufactured by WestRock Company. The board 100 may be made on a paper machine 70 (symbolically represented in FIG. 1B) and may be coated on one side with a conventional coating 110 selected for compatibility with the printing method and board composition. The coated side would typically be present on the external surface of the package to allow for printing of text or graphics. The coating may be done by one or more coaters as part of a paper machine 70, or on one or more separate coaters 80, or one partly on the machine and partly off-machine. The printable coating is optional. The result of the process shown in FIG. 1B is a paperboard structure 150 as shown in FIG. 2.

A barrier coating 120 may be applied to either side of substrate 100 (in FIG. 1A, applied to the side opposite from the printable coating 110) or to both sides by a suitable method such as one or more coaters either on the paper machine 70 or as off-machine coater(s) 90. The barrier coating 120 may optionally be heat sealable. When heated, a heat seal coating provides an adhesion to other regions of product with which it contacts.

If the barrier coating is applied as a single coat, a suitable coat weight may be, for example, from 6 to 15 lb/3000 $ft^2$ (9.8-24.5 $g/m^2$), or about 8 to 12 lb/3000 $ft^2$ (13.1-19.6 $g/m^2$).

If the barrier coating is applied as two coats, a suitable coat weight for the base coat may be, for example, from 6-10 lb/3000 $ft^2$ (9.8-16.3 $g/m^2$), or about 7-9 lb/3000 $ft^2$ (11.4-14.6 $g/m^2$). A suitable coat weight for the top coat may be, for example, from 5-8 lb/3000 $ft^2$ (8.2-13.1 $g/m^2$), or about 6-7 lb/3000 $ft^2$ (9.8-11.4 $g/m^2$).

A variety of coatings were applied on a paperboard substrate 100 using a pilot blade coater. The substrate was solid bleached sulfate (SBS), specifically 13 pt (330 μm) cupstock. The coatings used these pigments:

"Clay" kaolin clay, for example, a No. 1 ultrafine clay

"$CaCO_3$" coarse ground calcium carbonate (particle size 60%<2 micron)

The coatings used commercial binders based on styrene-acrylate (SA) but with different glass transition (Tg) temperatures as shown in Table 1.

TABLE 1

| BINDERS | | |
|---|---|---|
| Supplier | Binder Product | Tg, ° C. |
| BASF | Acronal S 866 | 39 |
| BASF | Acronal S 728 | 23 |
| BASF | Basonal X 400 AL | 14 |

TABLE 1-continued

| BINDERS | | |
|---|---|---|
| Supplier | Binder Product | Tg, ° C. |
| DOW | Rhoplex C-340 | 8 |
| BASF | Acronal S 504 | 4 |

The coating formulations are listed in Table 2, differing chiefly in the glass transition temperature of the styrene-acrylate (SA) binder. Pigment and binder were equal by weight (100 parts each), with the pigment split equally (50/50 parts each by weight) between clay and $CaCO_3$. Approximately 7.5-8 lb/3000 $ft^2$ (12.2-13.1 $g/m^2$) of the coating was applied by a pilot blade coater. The coated samples were tested for blocking using a method described later herein, and with ratings as listed in TABLE 3.

As shown in Table 2 and in FIG. 3, the conditions using SA binder with the lowest glass transition temperatures of 4° C. and 8° C. blocked badly (rating of 4). The conditions using SA binder with the intermediate glass transition temperatures of 14° C. and 23° C. did not block as much (ratings of 2-3). The condition using SA binder with highest-tested glass transition temperature of 39° C. only showed a little tackiness (rating of 1), and interestingly, it also had the best repulpability (99.6% fiber accepts).

TABLE 2

| COATING FORMULATIONS AND BLOCKING TESTS | | | | | |
|---|---|---|---|---|---|
| | SA Tg (° C.) | | | | |
| | 4 | 8 | 14 | 23 | 39 |
| Clay (parts) | 50 | 50 | 50 | 50 | 50 |
| $CaCO_3$ (parts) | 50 | 50 | 50 | 50 | 50 |
| SA (parts) | 100 | 100 | 100 | 100 | 100 |
| Coat Wgt (lb/3000 $f^2$) | 7.7 | 7.9 | 7.6 | 7.4 | 7.6 |
| Blocking | 4 | 4 | 2.3 | 3.2 | 1.2 |
| $H_2O$ Cobb ($g/m^2$-30 min) | 39 | 40 | 75 | 60 | 59 |
| WVTR ($g/m^2$-d) | 996 | 968 | 853 | 892 | 892 |
| Repulp (% accepts) | 94.1 | 94 | 99.4 | 94.6 | 99.6 |

TABLE 3

| BLOCKING TEST RATING SYSTEM |
|---|
| 0 = samples fall apart without any force applied |
| 1 = samples have a light tackiness but separate without fiber tear |
| 2 = samples have a high tackiness but separate without fiber tear |
| 3 = samples are sticky and up to 25% fiber tear or coat damage (area basis) |
| 4 = samples have more than 25% fiber tear or coat damage (area basis) |

Based on the promising results as seen in Table 2 with the glass transition temperature of 39° C., additional tests were run using the formulations seen in Table 4 below, in which the amount of SA binder was varied (100 parts, or 125 parts, or 150 parts), and the coatings were applied in either one or two layers. The single or base-coat weight was around 8.5 lb/3000 $ft^2$ (13.9 $g/m^2$), and the top coat (if used) was around 6.3 lb/3000 $ft^2$ (10.3 $g/m^2$). Blocking results again were good (ratings of 1.3 to 1.5).

TABLE 4

| ADDITIONAL COATING FORMULATIONS AND TESTS | | | | | | |
|---|---|---|---|---|---|---|
| | C-1 | | C-2 | | C-3 | |
| SA Tg (° C.) | 39 | | 39 | | 39 | |
| Clay (parts) | 50 | | 50 | | 50 | |
| $CaCO_3$ (parts) | 50 | | 50 | | 50 | |
| SA (parts) | 100 | | 125 | | 150 | |
| Base Coat Weight (lb/3000 $f^2$) | 8.4 | 8.4 | 8.7 | 8.7 | 8.5 | 8.5 |
| Top Coat Weight (lb/3000 $f^2$) | none | 6.2 | none | 6.3 | none | 6.5 |
| Blocking | 1.3 | 1.5 | 1.3 | 1.5 | 1.4 | 1.4 |
| Heat Seal (400° F., % fiber tear) | 100 | 100 | 100 | 98 | 100 | 100 |
| $H_2O$ Cobb ($g/m^2$-2 min) | 3.5 | 3.7 | 3 | 3.2 | 3.4 | 3.1 |
| $H_2O$ Cobb ($g/m^2$-30 min) | 57 | 52 | 51 | 39 | 49 | 28 |
| WVTR ($g/m^2$-d) | 860 | 460 | 823 | 445 | 832 | 474 |
| Oil Cobb ($g/m^2$-30 min) | 0.7 | | 0.3 | | 0.5 | |
| Repulp (% accepts) | 99.5 | 95.5 | — | 93.2 | — | 92.1 |

As shown in TABLE 4, heat seal testing (after sealing with a 400° F. (204° C.) tool) gave 98% to 100% fiber tear. Repulpability ranged from 99.5% for a single-coat using 100 parts of SA binder, down to 92.1% for a double-coat using 150 parts of the SA binder. All conditions gave 2-minute-water-Cobb ratings of less than 5 $g/m^2$.

With a single coat, coatings using 39° C. SA binder gave 3M Kit ratings of 7+ (not shown in Table 4), and 30-minute-oil-Cobb ratings of less than 1 $g/m^2$. Water vapor transmission rates (WVTR) of 820-860 $g/m^2$-d were achieved.

With a double coat, 30-minute-water-Cobb ratings were from 52 to 28, with the best (lowest) value for 150 parts SA. Water vapor transmission rates (WVTR) as low as 445-474 $g/m^2$-d were achieved.

Figure 4:
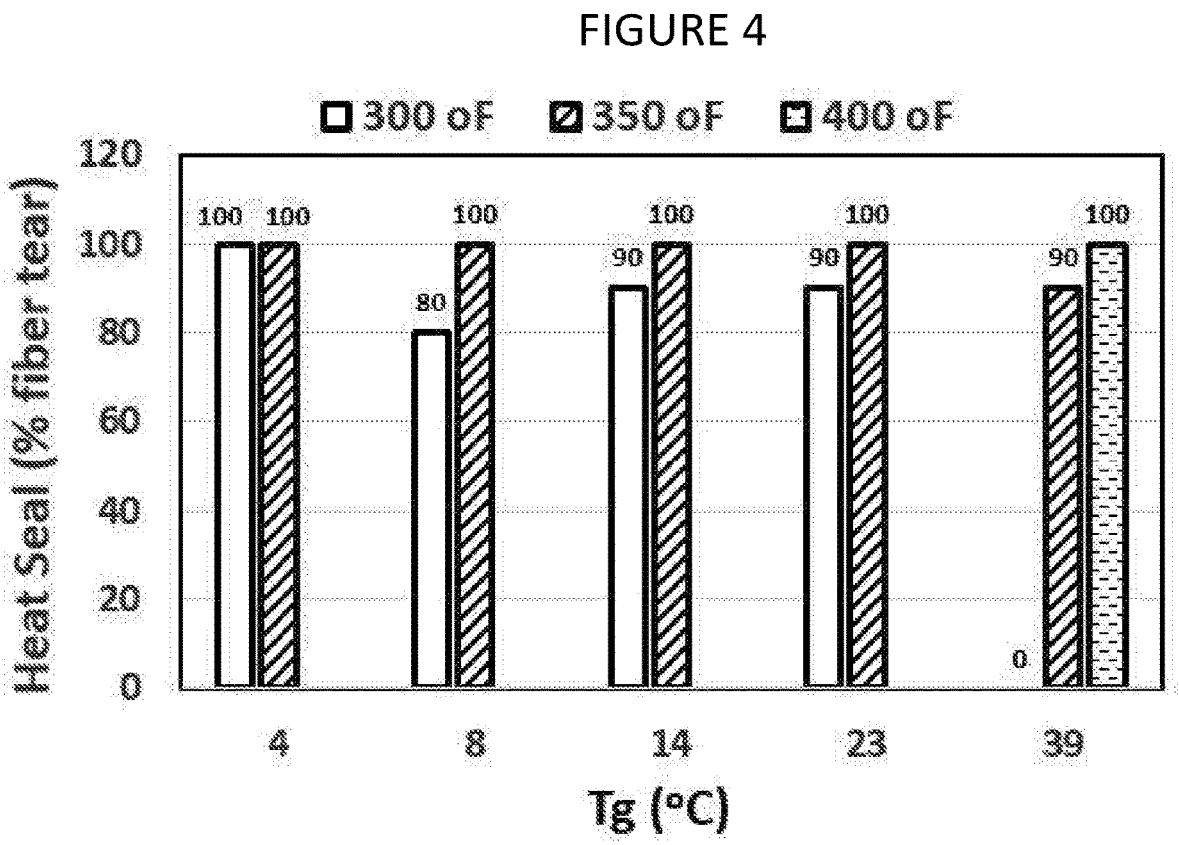
FIG. 4 illustrates results of heat sealing tests for coated paperboard samples.

FIG. 4 shows additional data from heat seal testing, where all five of the SA types were utilized, and the sealing temperature was either 300, 350, or 400° F. (149, 177, or 204° C.). For the SA binder with Tg of 4° C., seal bar temperatures of 300 and 350° F. (149 and 177° C.) gave 100% fiber tear. For the SA binders with Tg of 8 to 23° C., a seal bar temperature of 300° F. (149° C.) gave 80-90% fiber tear, and a seal bar temperature of 350° F. (177° C.) gave 100% fiber tear.

For the SA binders with Tg of 39° C., a seal bar temperature of 300° F. (149° C.) gave no fiber tear (0%), while seal bar temperatures of 350 and 400° F. (177 and 204° C.) gave 90% and 100% fiber tear, respectively.

Blocking Test Method

Figure 5:
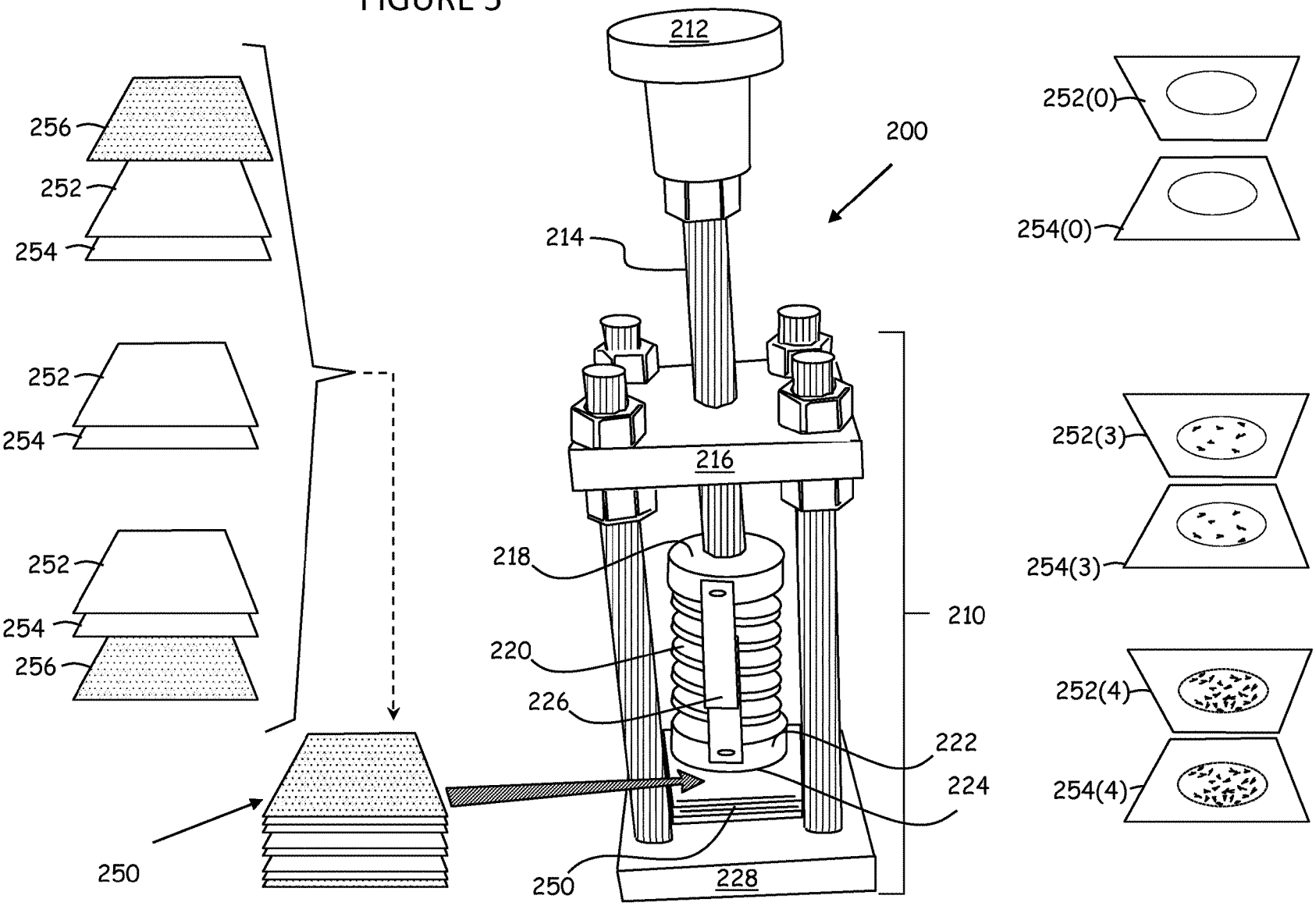
FIG. 5 is an illustration of a device for testing blocking of coated paperboard samples.

The blocking behaviour of the samples was tested by evaluating the adhesion between the barrier coated side and the other uncoated side. A simplified illustration of the blocking test is shown in FIG. 5. The paperboard was cut into 2"×2" (5.1 cm×5.1 cm) square samples. Several duplicates were tested for each condition, with each duplicate evaluating the blocking between a pair of samples 252, 254. (For example, if four duplicates were test, four pairs-eight pieces—would be used.) Each pair was positioned with the 'barrier-coated' side of one piece 252 contacting the uncoated side of the other piece 254. The pairs were placed into a stack 250 with a spacer 256 between adjacent pairs, the spacer being foil, release paper, or even copy paper. The entire sample stack was placed into the test device 200 illustrated in FIG. 5.

The test device 200 includes a frame 210. An adjustment knob 212 is attached to a screw 214 which is threaded through the frame top 216. The lower end of screw 214 is attached to a plate 218 which bears upon a heavy coil spring 220. The lower end of the spring 220 bears upon a plate 222 whose lower surface 224 has an area of one square inch (6.5 square centimeters). A scale 226 enables the user to read the applied force (which is equal to the pressure applied to the stack of samples through the lower surface 224).

The stack 250 of samples is placed between lower surface 224 and the frame bottom 228. The knob 212 is tightened until the scale 226 reads the desired force of 100 lbf (100 psi applied to the samples). The entire device 200 including samples is then placed in an oven at 50° C. for 24 hours. The device 200 is then removed from the test environment and cooled to room temperature. The pressure is then released, and the samples removed from the device.

The samples were evaluated for tackiness and blocking by separating each pair of paperboard sheets. The results were reported as shown in Table 3, with a "0" rating indicating no tendency to blocking.

Blocking damage is visible as fiber tear, which if present usually occurs with fibers pulling up from the non-barrier surface of samples 254. If the non-barrier surface was coated with a print coating, then blocking might also be evinced by damage to the print coating.

For example, in as symbolically depicted in FIG. 5, samples 252(0)/254(0) might be representative of a "0" rating (no blocking). The circular shape in the samples indicates an approximate area that was under pressure, for instance about one square inch of the overall sample. Samples 252(3)/254(3) might be representative of a "3" blocking rating, with up to 25% fiber tear in the area that was under pressure, particularly in the uncoated surface of sample 254(3). Samples 252(4)/254(4) might be representative of a "4" blocking rating with more than 25% fiber tear, particularly in the uncoated surface of sample 254(4). The depictions in FIG. 5 are only meant to approximately suggest the percent damage to such test samples, rather than showing a realistic appearance of the samples.

Heat Sealability Evaluation by Peel Test Method

The coated paperboard samples were evaluated for heat sealability. As depicted in FIG. 6A, a pair of 3-inch by 1-inch (7.6 cm by 2.5 cm) samples 301 and 305 were cut from the coated paperboard samples to be tested. The aqueous coated side was facing downwards for both 301 and 305. Next, as shown in FIG. 6B, a portion at one end of the samples 301, 305 was sealed together by placing between two surfaces 312, 314, with only top surface 312 being heated. A Sencorp White Ceratek 12ASL/1 bar sealer was used in this case, with only the upper bar being heated. Heat seal conditions were a sealing temperature of 300, 350, or 400° F. (149, 177, or 204° C.), a dwell time of 1.5 seconds, and a pressure of 50 psi (345 kPa). As shown in FIG. 6C, a 1 sq. inch (6.5 square centimeter) area 303 was sealed (e.g. 1-inch by 1-inch). After the samples being cooled down, the sealed samples were then pulled apart by hand as schematically shown in FIG. 6D. The fiber tear area was estimated as percentage of the tested area 303.

Repulping Testing Procedures

Repulpability was tested using an AMC Maelstom repulper. 110 grams of coated paperboard, cut into 1"×1" (2.5 cm×2.5 cm) squares, was added to the repulper containing 2895 grams of water (pH of 6.5±0.5, 50° C.), soaked for 15 minutes, and then repulped for 30 minutes. 300 mL of the repulped slurry was then screened through a vibrating flat screen (0.006" (152 μm) slot size). Rejects (caught by the screen) and fiber accepts were collected, dried and weighed. The percentage of accepts was calculated based on the weights of accepts and rejects, with 100% being complete repulpability.

Barrier Testing Methods

Moisture resistance of the coatings was evaluated by WVTR (water vapor transmission rate at 38° C. and 90% relative humidity; TAPPI Standard T464 OM-12) and water Cobb (TAPPI Standard T441 om-04).

The oil and grease resistance (OGR) of the samples was measured on the 'barrier side' by the 3M kit test (TAPPI Standard T559 cm-02). With this test, ratings are from 1 (the least resistance to oil and grease) to 12 (excellent resistance to oil and grease penetration).

In addition to 3M kit test, oil absorptiveness (oil Cobb) was used to quantify and compare the OGR performance (oil and grease resistance), which measures the mass of oil absorbed in a specific time, e.g., 30 minutes, by 1 square meter of coated paperboard. For each condition tested, the sample was cut to provide two pieces each 6 inch×6 inch (15.2 cm×15.2 cm) square. Each square sample was weighed just before the test. Then a 4 inch×4 inch (area of 16 square inches or 0.0103 square meters) square of blotting paper saturated with peanut oil was put on the center of the test specimen (barrier side) and pressed gently to make sure the full area of oily blotting paper was contacting the coated surface. After 30-minutes as monitored by a stop watch, the oily blotting paper was gently removed using tweezers, and the excess amount of oil was wiped off from the coated surface using paper wipes (Kimwipes™). Then the test specimen was weighed again. The weight difference in grams before and after testing divided by the test area of 0.0103 square meters gave the oil Cobb value in grams/square meter.

The invention claimed is:

1. A paperboard comprising:

a substrate having a first side and an opposing second side; and a layer applied on the first side as an aqueous coating forming an outer surface for the first side, wherein the aqueous coating comprises:

a pigment blend; and a binder consisting of styrene-acrylate having a glass transition temperature above 20° C., wherein a ratio of the binder to the pigment blend is at least 1 part binder per 1 part pigment blend, by weight, wherein the layer is heat sealable, wherein the paperboard has a blocking rating below 2, and wherein the paperboard is at least 90% repulpable.

2. The paperboard of claim 1, wherein the glass transition temperature is above 30° C.

3. The paperboard of claim 1, wherein the glass transition temperature is above 35° C.

4. The paperboard of claim 1, further comprising a printable coating on the second side.

5. The paperboard of claim 1, wherein the ratio of the binder to the pigment blend is at least 1.25:1 by weight.

6. The paperboard of claim 1, wherein the ratio of the binder to the pigment blend is at least 1.5:1 by weight.

7. The paperboard of claim 1, wherein a heat seal formed between the first side and the second side, when made with a sealing bar at 350° F. (177° C.) and 50 psi (345 kPa) for 1.5 seconds, provides adhesion to the extent of 80% or greater fiber tear.

8. The paperboard of claim 7, wherein a heat seal between the first side and the second side, when made with a sealing bar at 400° F. (204° C.) and 50 psi (345 kPa) for 1.5 seconds, provides adhesion to the extent of at least 80% fiber tear.

9. The paperboard of claim 7, wherein a heat seal between the first side and the second side, when made with a sealing bar at 400° F. (204° C.) and 50 psi (345 kPa) for 1.5 seconds, provides adhesion to the extent of at least 90% fiber tear.

10. The paperboard of claim 1, exhibiting no fiber tear after being held under 100 psi (689 kPa) pressure at 50° C. for 24 hours.

11. The paperboard of claim 1, wherein the aqueous coating has a dry weight from 6 to 15 lb/3000 $ft^2$ (9.8-24.5 $g/m^2$).

12. The paperboard of claim 1, wherein the aqueous coating has a dry weight from 8 to 12 lb/3000 $ft^2$ (13.1-19.6 $g/m^2$).

13. The paperboard of claim 1, wherein the aqueous coating is applied in two coats.

14. The paperboard of claim 1, wherein the substrate comprises at least one of solid bleached sulfate and natural kraft board.

15. The paperboard of claim 1, providing a 2-minute water Cobb test of less than 5 $g/m^2$.

16. The paperboard of claim 1, providing a 30-minute water Cobb test of less than 60 $g/m^2$.

17. The paperboard of claim 1, providing a 30-minute oil Cobb test of less than 1 $g/m^2$.

18. The paperboard of claim 1, providing a water vapor transmission rate of less than 900 $g/m^2$.

19. The paperboard of claim 1, providing a water vapor transmission rate of less than 500 $g/m^2$.

20. The paperboard of claim 1, having a 3M Kit test rating of at least 7.

21. The paperboard of claim 1, being at least 95% repulpable.

22. The paperboard of claim 1, wherein the pigment blend comprises clay and calcium carbonate.

23. The paperboard of claim 22, wherein a ratio of the clay to the calcium carbonate is about 1:1.

* * * * *